United States Patent [19]

Massarelli et al.

[11] Patent Number: 4,998,392

[45] Date of Patent: Mar. 12, 1991

[54] DEVICE FOR MOUNTING INSULATING DOUBLE-GLAZING ONTO A FIXED FRAME

[75] Inventors: Liberto Massarelli; Roberto Sampaolesi, both of Vasto, Italy

[73] Assignee: Società Italiana Vitro-SIV-S.p.A., San Salvo CH, Italy

[21] Appl. No.: 491,852

[22] Filed: Mar. 12, 1990

[30] Foreign Application Priority Data

Mar. 15, 1989 [IT] Italy ..... 47742 A/89

[51] Int. Cl.[5] ..... E06B 3/66

[52] U.S. Cl. ..... 52/208; 156/91; 156/108; 248/208; 428/34

[58] Field of Search ..... 52/135, 208, 768, 788, 52/790, 204; 156/91, 108; 248/208; 428/34

[56] References Cited

U.S. PATENT DOCUMENTS 2,730,777 1/1956 Koriagin ..... 52/208

2,748,431 6/1956 Eriksson ..... 52/208

*Primary Examiner*—Robert A. Dawson

*Attorney, Agent, or Firm*—Wenderoth, Lind & Ponack

[57] ABSTRACT

A device for mounting double-glazing onto a fixed frame is formed by two distinct members, the first of which at which is mechanically bonded to the double-glazing and the second is secured to the frame. The two members are coupled together by a pivotal connection. This device enables any stress applied to the glass to be considerably reduced, thus prolonging the life thereof and reducing the quantity of adhesive required.

15 Claims, 2 Drawing Sheets

DEVICE FOR MOUNTING INSULATING DOUBLE-GLAZING ONTO A FIXED FRAME

BACKGROUND OF THE INVENTION

1. Field of the Invention

The present invention relates to insulating double-glazing glass and refers in particular to a device for the mounting thereof on a fixed frame, more preferably onto a preformed border structure defining an opening in a building.

In the following description, the expression "insulating glass" will be also used to include "insulating double-glazing".

Double-glazing according to the present invention is intended to be applied on fixed windows, always to be kept locked shut.

2. Description of the Prior Art

Insulating windows known in the art are conventionally constructed by two sheets of glass between which a metal frame is interplaced and bonded together by a sealant along their peripheral edges.

The frame serves to define an air space between the sheets of glass and also contains dehydrating substances on the inside. The frame is usually employed as a spacer and this term will be used in the following description.

The sheets of glass and the spacer are bonded together by two sealing agents. The first sealant is butyl-based in order to prevent moisture seepage into the air space and avoid internal misting of the sheets of glass. The second sealant acts to bond together the components of the insulating glass and protect them from the outside atmospheric conditions.

Insulating double-glazing thus prepared is then mounted, by methods already known in the art, on pre-constructed frames which are in turn mounted on building walls.

In a modified embodiment, the double-glazing can be fixed directly onto the window structure with fastening members, thereby improving its appearance in that none of the components of the structure are shown apart from the glass.

The sealant used for securing the insulating glass onto the building structure is a commercially available high-strength adhesive, particularly suited to such applications, which is commonly known as structural silicone. This term will hereinafter used.

As said hereinbefore, the inner sheet of the insulating glass is secured to the building structure by bonding, whereas the outer sheet is held fast by the cohesive force exerted by the structural silicone inserted into the peripheral cavity between the outer edges of the two sheets of glass and the spacer.

Consequently, under particularly severe environmental conditions, such as a strong winds or heavy rain, or in the event of excessive structural strain impairted there to by the building, a partial or total breaking of the structural silicone junctions between the sheets could occur thereby detaching the insulating glass from the building face.

It should also be noted that following the above indicated assembly procedure, the quantity of structural silicone required to hold together the sheets forming the insulating glass and to bond the insulating glass to the building structure is rather large. In fact, each element is bonded to the adjacent one and these bonds must also ensure the required sealing.

SUMMARY OF THE INVENTION

The object of the present invention is to overcome the above-mentioned drawbacks of the prior art.

To achieve the above object, the present invention comprises mechanical members which act to secure the insulating glass to the building structure without bonding and at the same time provide a pivotal connection between the insulating glass and the building structure.

The advantages provided by this device are self-evident.

The pivotal connection prevents structural stress or external pressure applied on the sheets of glass from being transmitted to the spacer in the insulating glass, which is the weakest point of the system as it has to hold fast the first sealant which prevents moisture seepage. With the pivotal connection one can extend the durability of the insulating glass by preventing the breaking of the first sealant and consequent moisture seepage. This would result in irreversible damage to the glass and, in more serious cases, in the detachment of the outer sheet due to the breaking of the sealant. Providing a connecting member between the two sheets of insulating glass is a further mechanical safety measure against the detachment of the inner sheet from the building structure. A further advantage is that a considerably lower quantity of structural silicone is required, as the silicone is applied only along the outer periphery of the insulating glass. Moreover, the assembly of the insulating glass can be carried out off-site. This leaves only one of the two connecting members to be applied with only one peripheral sealing operation.

The above-mentioned advantages therefore result in an extended durability of the double-glazing, in a reduced likelyhood of the glass detaching from the building under particularly severe environmental conditions and in an overall reduced manufacturing cost.

In view of the above, the objects of the present invention are realized by the provision of a device for mounting insulating double-glazing onto a fixed frame of a border structure preformed in an opening in a building wall, the double-glazing insulating glass being formed by two sheets of glass held in place by a spacer bonded thereto, and the first sealant filling the space between the spacer and the edges of the sheets of glass, the device comprising: a first elongated connecting member placed along at least one pair of opposite peripheral edges of the glass, formed with a strip portion at least partially embedded edgewise in said first sealant so as to be bonded to the edges of the sheets of glass, and a pivot portion integral with the strip portion on the free edge thereof, which defines a pivotal axis parallel to the peripheral edges of the glass; a second elongated connecting member formed with a receiving portion including a longitudinallly extending bore for housing said pivot portion of the first connecting member, and a mounting portion coextensive to the receiving portion; and means for fixing the mounting portion to the frame, whereby the insulating double-glazing is fixedly mounted to the border structure through a pivotal connection, to allow a partial relative deformation of the glass and the structure.

BRIEF DESCRIPTION OF THE DRAWINGS

The invention will be described in greater detail hereinafter by reference to the drawings showing a preferred embodiment thereof.

DETAILED DESCRIPTION OF THE PREFERRED EMBODIMENT

Figure 1:
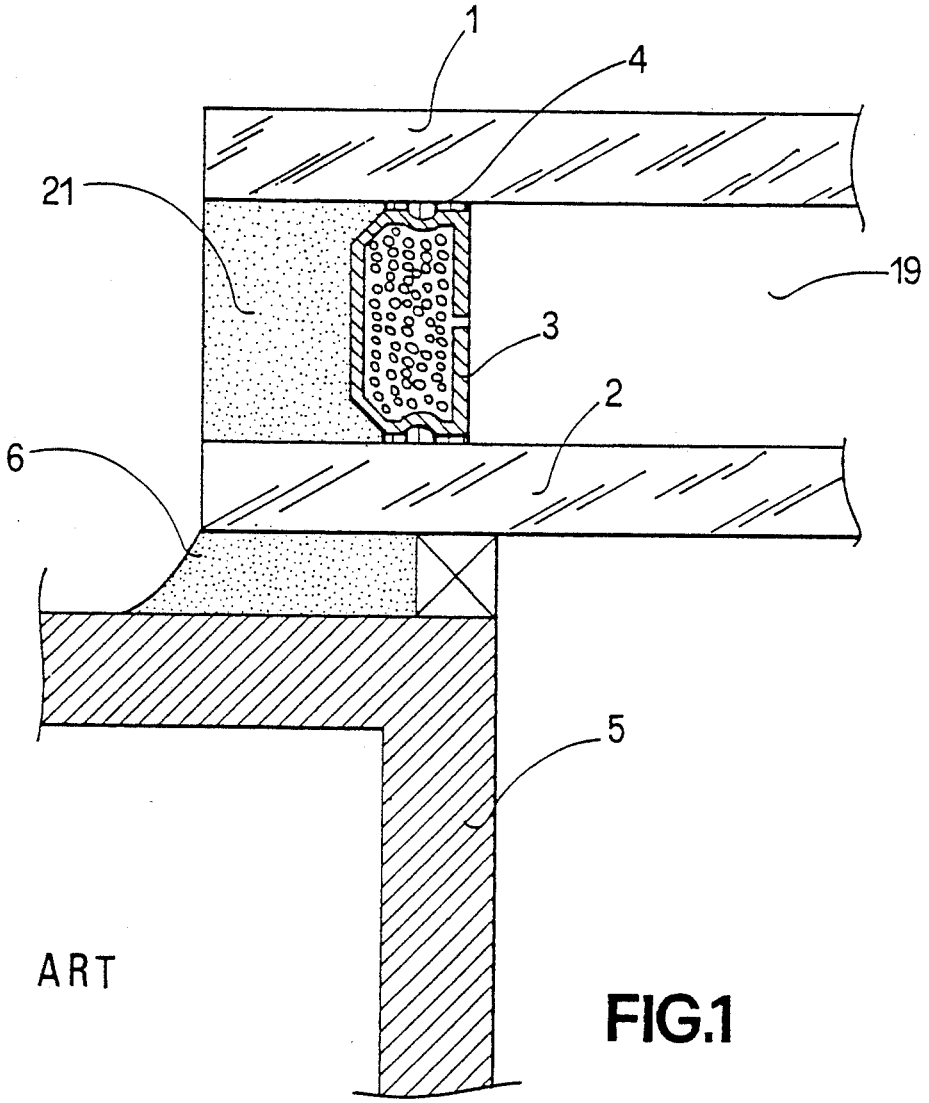
PRIOR ART FIG.1
FIG. 1 is a horizontal cross-sectional view of insulating glass mounted on a building face using a prior art method.

Referring to FIG. 1, the double-glazing is formed of a sheet of glass 1 and a sheet of glass 2 held apart by a spacer 3 which define an air space 19.

Each sheet of glass is bonded to the spacer with an adhesive 4, preferably a butyl-based adhesive, acting as a moisture barrier to prevent any inner misting of the sheets of glass.

The inner glass 1 is bonded to a frame 5 by a commercially available sealant 6 known in the art as structural silicone, which is particularly suited to such applications.

Structural silicone is applied to the outer peripheral cavity 21 defined between sheets 1, 2 and the spacer 3, in order to hold the two sheets together. In fact, whereas the butyl adhesive 4 is suited to act as a moisture barrier, it cannot ensure a sufficiently strong cohesive force under strong tensile and/or torsional stress.

Figure 2:
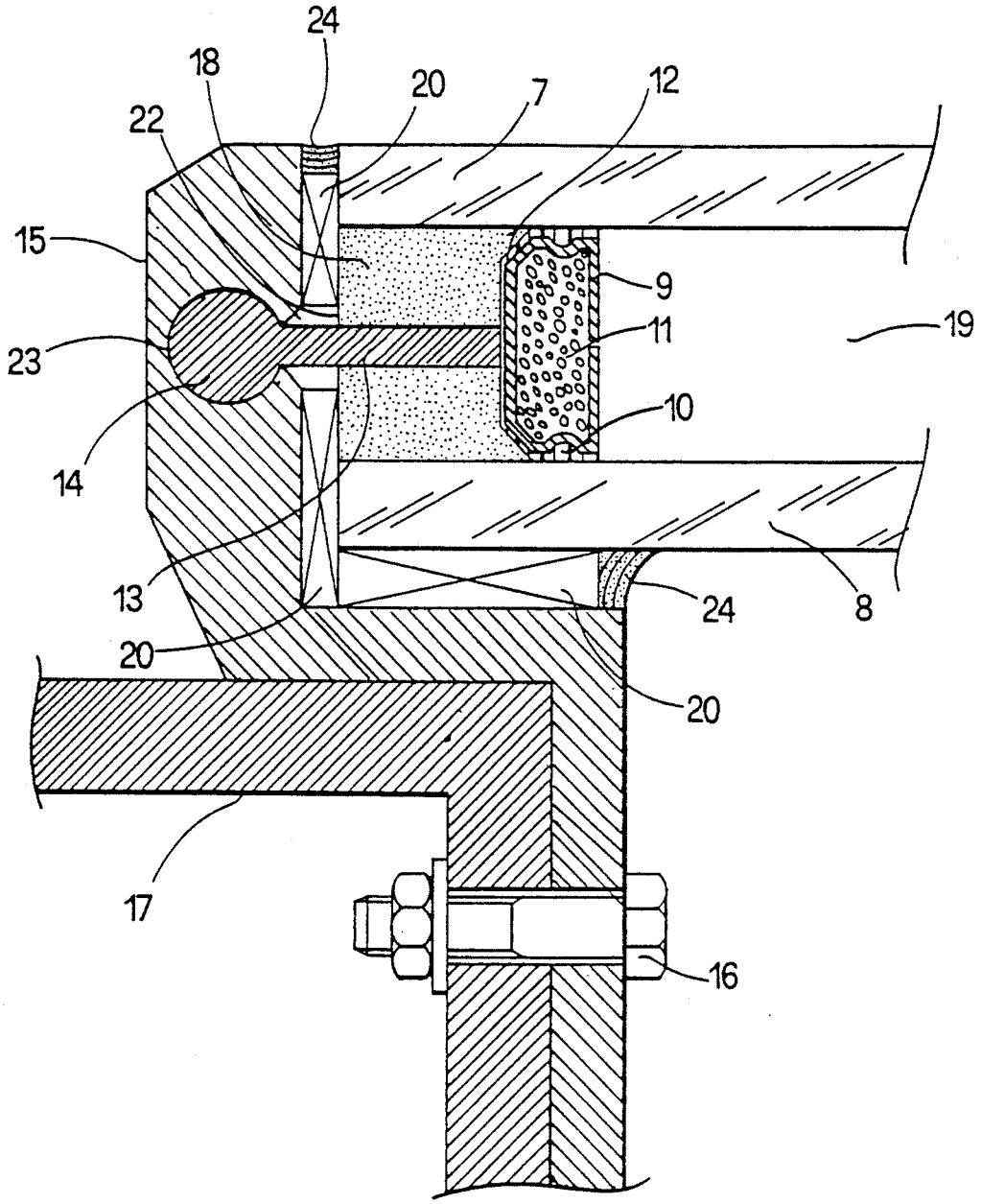
FIG. 2 is a horizontal cross-sectional view of insulating glass mounted on a building face using a device according to the present invention.

In FIG. 2, according to the present invention, the insulating glass comprises a sheet of glass 7, a sheet of glass 8 and a spacer 9 bonded between the two sheets of glass by a butyl adhesive 10, which acts as a moisture barrier.

The inside space 11 of the spacer 9 contains dehydrating substances for eliminating any moisture possibly present in the air space 19 between the two sheets.

A film of insulating material 12, preferably polyethylene or a non-adhesive paint, coats the outer surface of the spacer 9. The film 12 is adhered by means of a glue of low cohesive strength, separating the spacer and the structural silicone 18 filling the outer peripheral cavity 22. In such a way the spacer 9 remains independent of any stress transmitted to the structural silicone 18.

A metal member 13 is secured in the cavity 22 and bonded therein by the structural silicone 18. In a particularly preferred embodiment, the member 13 has a strip configuration having a cylindrical pivot 14 on one of its edges.

A second metal member 15 is provided with a longitudinally extending bore 23 for housing the cylindrical pivot 14, so that the metal member 15 may rotate about an axis defined by bore 23, adjusting to any slight relative movement.

Bolts 16 are provided to fasten the member 15 to a fixed frame 17.

Positioning blocks 20, preferably of plastic material, are placed between the lower edge of the sheets and the member 15, so as to prevent any direct contact between glass and metal which could damage the glass.

A silicone adhesive 24, particularly suited for exposure to the outside environment, seals the remaining apertures.

The connecting member 15 follows the entire peripheral profile of the insulating glass and receives the pivot 14 in the bore 23. In a preferred embodiment the pivot 14 also extends around the entire periphery of the glass.

In both these arrangements, any stress brought to bear on the insulating glass is transmitted from the member 13, along its entire peripheral profile, to the member 15 and any torsional stress is neutralized along the contact surface between pivot 14 and metal member 15 of bore 23 in the connecting member 15 and the building structure.

The connecting members can be made of any suitable material, provided that the material has mechanical properties capable of withstanding stress and corroding action from the outside environment, and provided that the materials of which the connecting members made, are will provide a sliding contact that allows for their relative reciprocal pivotal movement. Preferably metal materials are used, such as steel or stainless steel, aluminum or aluminum alloys, brass and the like.

Having described a preferred embodiment of the invention, it is understood that modifications and variations thereto can be devised within the spirit and the scope of the invention.

For example, in a modified embodiment of the present invention, the pivot 14 can be placed only on two of the four sides of the insulating glass, typically on two vertical or two horizontal sides. Moreover the pivot 14 can be discontinuous, provided adequate strength conditions allow it.

In an additional embodiment, the connecting pivot 14 can be formed of a plurality of spheres integral with the strip portion, which are received in the housing provided by the connecting member 15. In such a case, any stress on the glass will be transmitted to the contact points of the connecting members.

In a further modification, the insulating glass is formed by an inner sheet of glass having a smaller surface area the outer sheet. In this case the member 13 is placed in the step formed between the outer and the inner sheet and is bonded only to the edge of the outer glass by structural silicone.

We claim:

1. In combination with insulating double-glazing formed by two sheets of glass held in place by a spacer bonded thereto, and a first sealant filling a space defined between said spacer and peripheral edges of said sheets of glass, a device for mounting the double-glazing to a fixed frame of border structure defining an opening in a wall, said device comprising:

a first elongate connecting member extending along at least one pair of opposite peripheral edges of said sheets of glass, said first elongate connecting member including a strip portion at least partially embedded edgewise in said first sealant so as to be bonded to said sheets of glass at the edges thereof, and a pivot portion integral with said strip portion at a free edge thereof, said pivot portion comprising a plurality of sphere-shaped elements defining a pivotal axis parallel to the at least one pair of peripheral edges of said sheets of glass;

a second elongate connecting member having a receiving portion defining a longitudinally extending bore therein and in which bore said pivot portion of the first connecting member is housed with the pivotal axis defined thereby extending parallel to the longitudinal axis of said bore, and a mounting portion coextensive with said receiving portion; and means for fixing said mounting portion to the frame such that the insulating double-glazing is capable of being fixedly mounted to the border structure through a pivotal connection established between said pivotal portion and said receiving portion to allow a partial relative deformation of said sheets of glass and the structure.

2. The combination as claimed in claim 1, in which the device further includes spacer blocks interposed between said sheets of glass and said second connecting member.

3. The combination as claimed in claim 6, in which said spacer blocks are of plastic material.

4. The combination as claimed in claim 1, in which a film of insulating material is bonded on the outer surface of said positioning spacer by an adhesive of low cohesive force.

5. The combination as claimed in claim 1, in which said means for fixing the mounting portion to the fixed frame are metal bolts.

6. The combination as claimed in claim 1, in which said elongate connecting members are each of a material selected from the group consisting of steel, stainless steel, aluminum, aluminum alloy and brass.

7. In combination with insulating double-glazing formed by two sheets of glass held in place by a spacer bonded thereto, and a first sealant filling a space defined between said spacer and said peripheral edges of said sheets of glass, a device for mounting the double-glazing to a fixed frame of border structure defining an opening in a wall, said device comprising:

a first elongate connecting member extending along at least one pair of opposite peripheral edges of said sheets of glass, said first elongate connecting member including a strip portion at least partially embedded edgewise in said first sealant so as to be bonded to said sheets of glass at the edges thereof, and a pivot portion integral with said strip portion at a free edge thereof, said pivot portion having a configuration defining a pivotal axis parallel to the at least one pair of peripheral edges of said sheets of glass;

a second elongate connecting member having a receiving portion defining a longitudinally extending bore therein and in which bore said pivot portion of the first connecting member is housed with the pivotal axis defined thereby extending parallel to the longitudinal axis of said bore, and a mounting portion coextensive with said receiving portion; and means for fixing said mounting portion to the frame such that the insulating double-glazing is capable of being fixedly mounted to the border structure through a pivotal connection established between said pivotal portion and said receiving portion to allow a partial relative deformation of said sheets of glass and the structure.

8. The combination as claimed in claim 7, in which said pivot portion of the first connecting member has a cylindrical configuration.

9. The combination as claimed in claim 7, in which said pivot portion having a cylindrical configuration extends continuously along the entirety of the peripheral edges of said insulating double-glazing.

10. The combination as claimed in claim 7, in which said pivot pattern comprises a plurality of axially aligned cylindrically shaped sections spaced from each other in the axial direction thereof.

11. The combination as claimed in claim 7, in which the device further includes spacer blocks interposed between said sheets of glass and said second connecting member.

12. The combination as claimed in claim 11, in which said spacer blocks are of plastic material.

13. The combination as claimed in claim 7, in which a film of insulating material is bonded on the outer surface of said spacer by an adhesive of low cohesive force.

14. The combination as claimed in claim 7, in which said fixing means for fixing the mounting portion to the fixed frame are metal bolts.

15. The combination as claimed in claim 7, in which said elongate connecting members are each of a material selected from the group consisting of steel, stainless steel, aluminum, aluminum alloy and brass.

* * * * *